US011896054B2

(12) United States Patent
Kokadir

(10) Patent No.: US 11,896,054 B2
(45) Date of Patent: Feb. 13, 2024

(54) ELECTRONIC EVAPORATOR TO TRANSFER MEDICINE OR NICOTINE WITH PERFORATED HEATING COIL

(71) Applicants: Ramadhan Fathurizki, West Jarkata (ID); Sucipto Kokadir, Jarkata Barat (ID)

(72) Inventor: Sucipto Kokadir, Jarkata Barat (ID)

( * ) Notice: Subject to any disclaimer, the term of this patent is extended or adjusted under 35 U.S.C. 154(b) by 229 days.

(21) Appl. No.: 17/278,604

(22) PCT Filed: Mar. 3, 2020

(86) PCT No.: PCT/IB2020/051768
§ 371 (c)(1),
(2) Date: Mar. 22, 2021

(87) PCT Pub. No.: WO2021/064477
PCT Pub. Date: Apr. 8, 2021

(65) Prior Publication Data

US 2022/0110366 A1 Apr. 14, 2022

(30) Foreign Application Priority Data

Oct. 3, 2019 (ID) ..... S00201908739
Nov. 28, 2019 (ID) ..... P00201911060

(51) Int. Cl.
*A24F 40/46* (2020.01)
*A24F 40/10* (2020.01)
*A24F 40/44* (2020.01)

(52) U.S. Cl.
CPC ..... *A24F 40/46* (2020.01); *A24F 40/10* (2020.01); *A24F 40/44* (2020.01)

(58) Field of Classification Search
CPC ..... A24F 40/46; A24F 40/10; A24F 40/04
See application file for complete search history.

(56) References Cited

U.S. PATENT DOCUMENTS

| | | | | |
|---|---|---|---|---|
| 2007/0139976 | A1* | 6/2007 | deRochemont | H01G 4/10 363/17 |
| 2008/0102309 | A1* | 5/2008 | Tuffile | H05B 3/52 428/685 |
| 2017/0055580 | A1* | 3/2017 | Blandino | A24D 1/20 |
| 2017/0340011 | A1* | 11/2017 | Batista | A24F 40/44 |
| 2020/0300739 | A1* | 9/2020 | Algarni | H05B 3/283 |

* cited by examiner

*Primary Examiner* — Truc T Nguyen
(74) *Attorney, Agent, or Firm* — Judd M. Patton, Esq.

(57) ABSTRACT

A perforated coil surface vaporizing element which may have a negative and positive lead, the leads may be configured for electrical communication with an anode portion and a cathode portion, respectively, of a galvanic cell. The perforated coil surface vaporizing element may be shaped as a helix tubule coil sheet. The coil sheet which may connect to and span between the positive and negative lead. The tubule may further be resistive to electron flow and may generate heat upon passage of electrons from the positive lead to the negative lead. The perforations of the helix tubule coil sheet may be in multiplicity. An aperture may traverse through the middle of the helix tubule and may be further configured to receive a wicking material. The wicking material maintaining fluid communication with a liquid medium for vaporization.

15 Claims, 11 Drawing Sheets

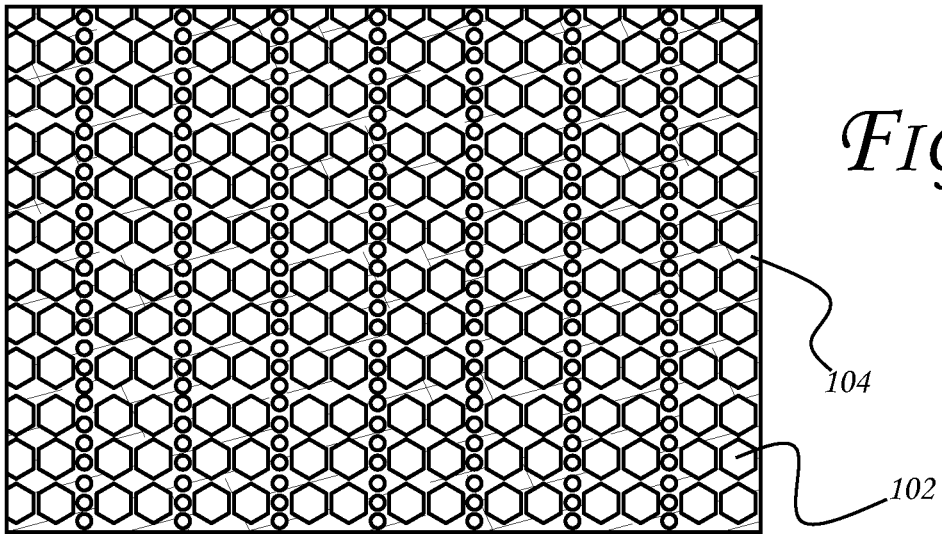
FIG. 12
FIG. 13
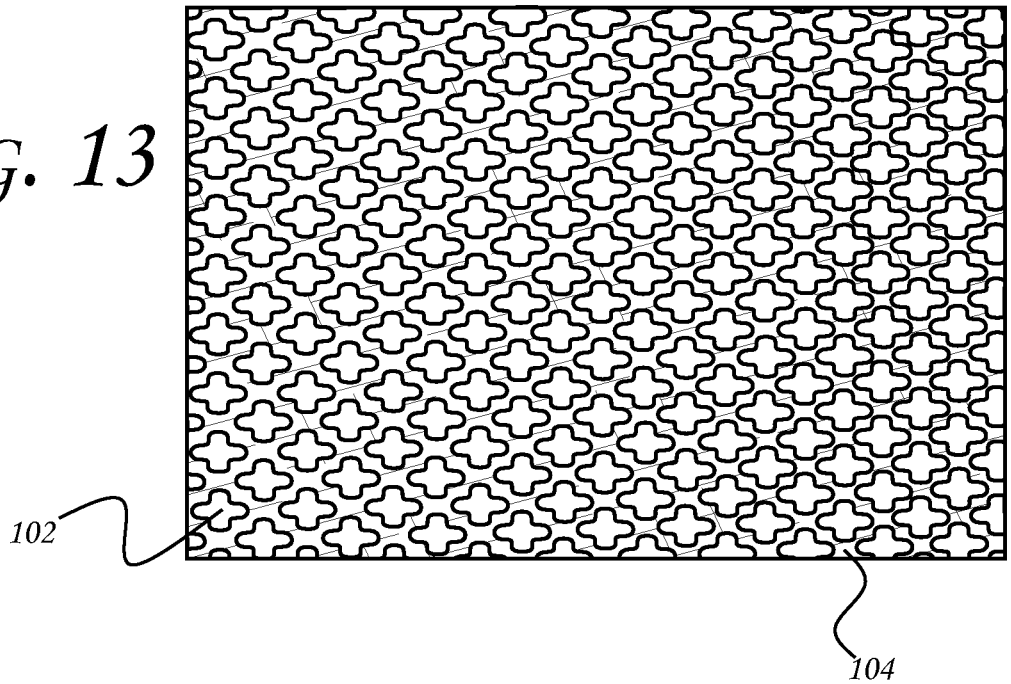

FIG. 17
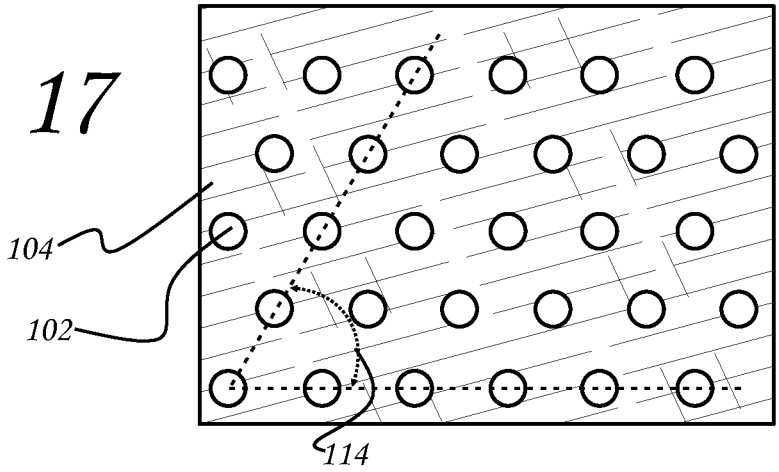
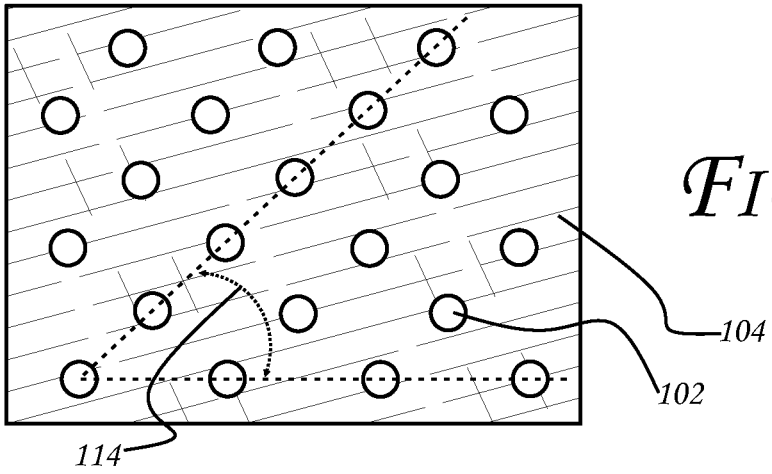
FIG. 18
FIG. 19
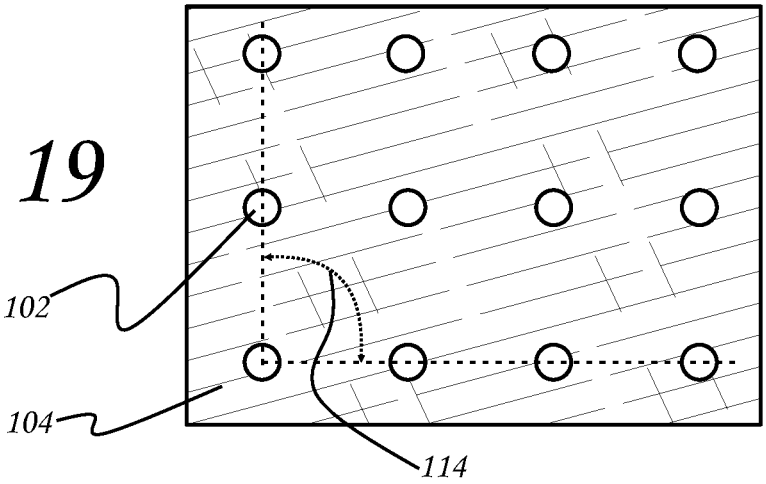

FIG. 20
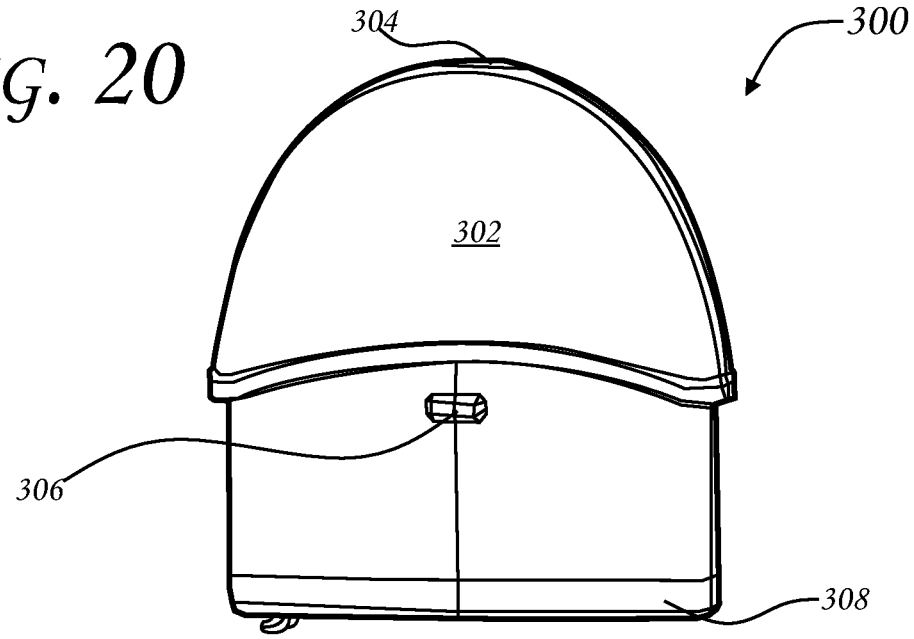
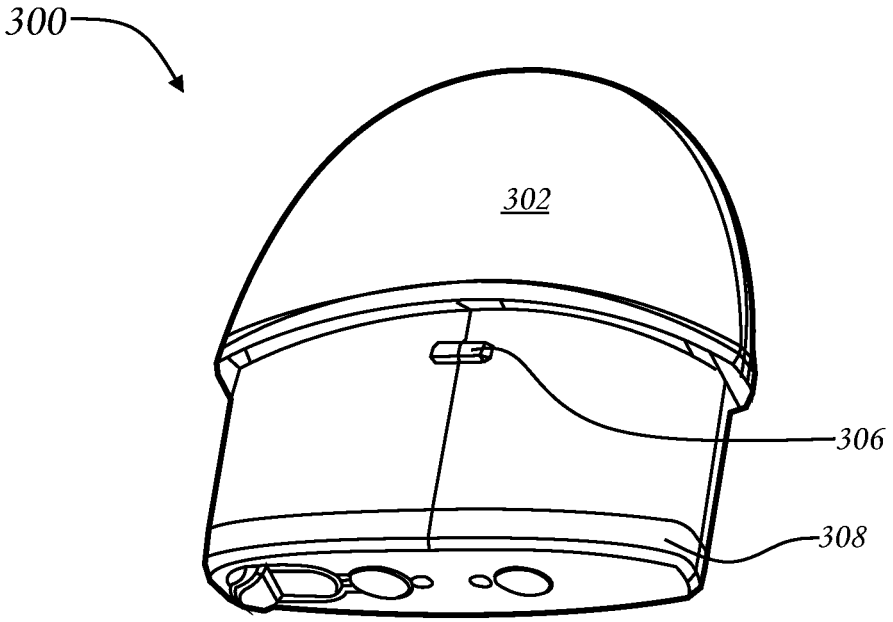
FIG. 21

FIG. 23
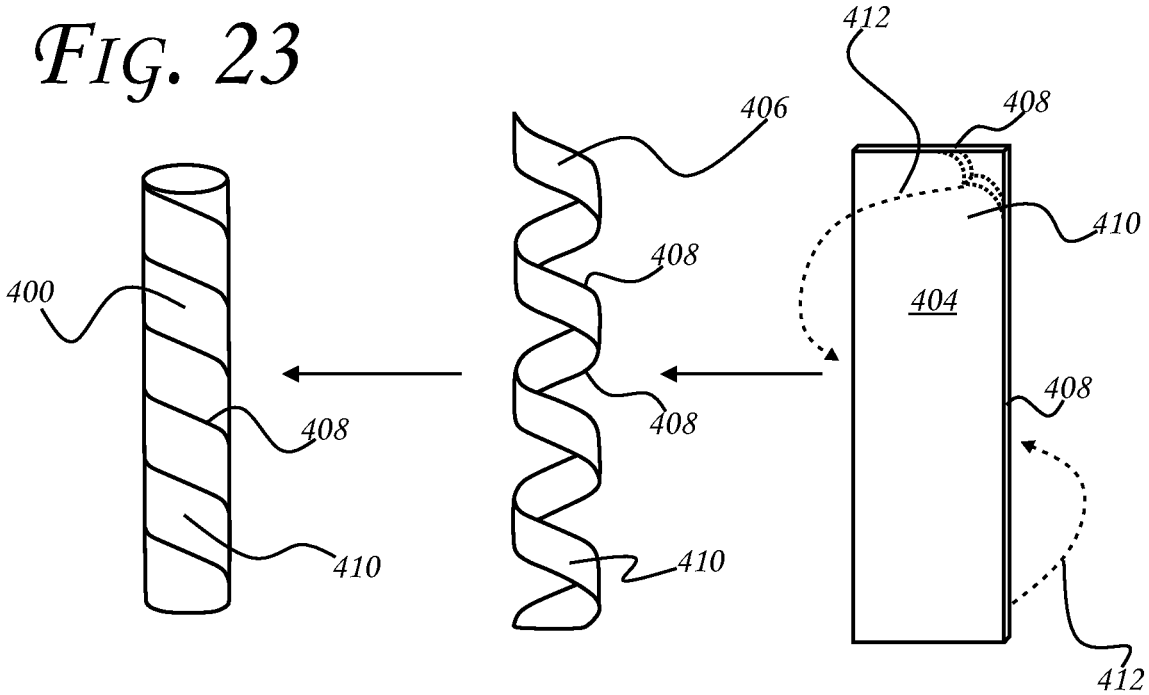
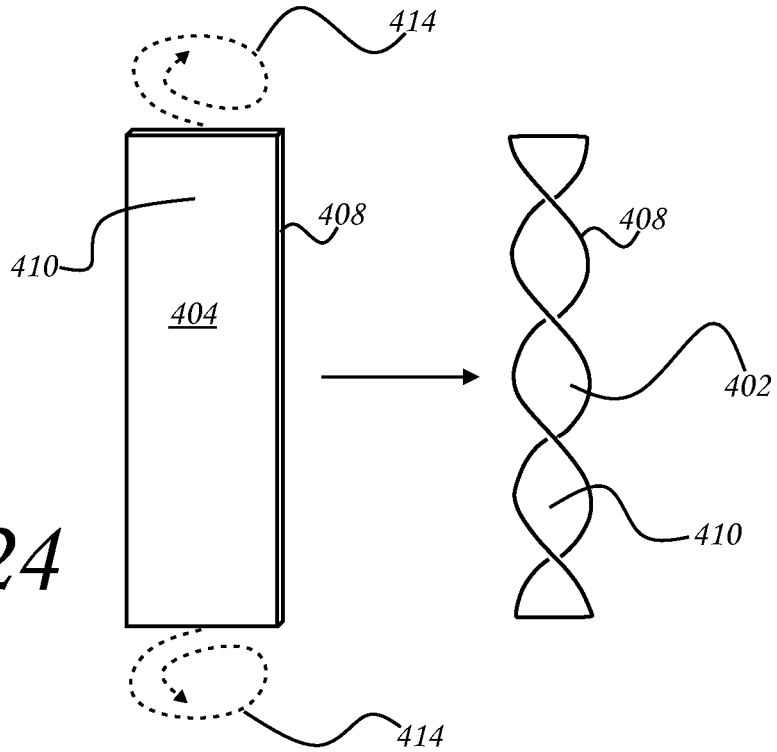
FIG. 24

ELECTRONIC EVAPORATOR TO TRANSFER MEDICINE OR NICOTINE WITH PERFORATED HEATING COIL

RELATED APPLICATIONS

This application is a U.S. national stage of PCT International Patent Application No. PCT/IB2020/051768, filed Mar. 3, 2020, which claims the benefit of Indonesian patent number S00201908739, filed Oct. 3, 2019; Indonesian patent number P00201911060, filed, Nov. 28, 20199. All of the above-identified applications are incorporated by this reference in their entireties for all purposes as if fully set forth herein.

TECHNICAL FIELD

The disclosure herein relates generally to electronic cigarettes. More particularly, the disclosure relates to heating coil configurations and designs wherein said configurations results in improved efficiency, taste, and function of the heating coil by way of applications of perforations.

BACKGROUND

Throughout history people have used and consumed tobacco and tobacco products. This has been encouraged by the tobacco industry through the presentation of advertisements that reflect a lifestyle in which tobacco use and consumption is normalized. Further, marketing coverage by the tobacco industry in addition to the social influence makes a combination strong enough to increase the number of smokers even in the face of seriously fatal diseases. This effect is seen even though consumers of tobacco products understand the effects of tobacco and fully comprehend that nicotine can easily become addictive.

One answer to the endemic problems associated with tobacco consumption is that of the use of electronic cigarettes and the various related products as a replacement to conventional cigarettes and other plant-based tobacco products. Electronic cigarettes use a liquid medium which may contain little or no nicotine, can be atomized into vapor, and are less harmful to the users of the electronic cigarette than that of conventional tobacco products. The vapor can be inhaled by smokers the same as it is done with a conventional cigarette. A consequence of using electronic cigarettes is that smokers may control the nicotine and thus they aid helping smokers quit smoking entirely by slowly becoming less addicted to nicotine.

In general, the atomization portion of the electronic cigarette has a heating unit, or coil, positioned within the atomization chamber. Typically, the heating coil is responsible for the evaporation of the liquid medium and comes in the form of a wound wire. Unfortunately, it is difficult to get a wire to provide maximum efficiency in the evaporation process due to the wire having a narrow heating area.

What is needed is a system that permits for the effective, efficient, and quality evaporation process which is not limited by the geometric limitations of a wound wire. Such a system would be able to rapidly heat without overheating and would provide a large surface area for the absorption and subsequent evaporation of a liquid medium.

SUMMARY

The systems, methods, and devices described herein have innovative aspects, no single one of which is indispensable or solely responsible for their desirable attributes. Further, certain deficiencies of the prior art are overcome by the provision of embodiments of an apparatus, kit, and system in accordance with this present disclosure. Without limiting the scope of the claims, some of the advantageous features will now be summarized.

This disclosure may relate to a heating element for the evaporation of a liquid medium which may comprise a resistively conductive coil sheet. The coil sheet may span between a positive lead and a negative lead of a battery thereby resulting in electrical communication with the battery. The coil sheet may have a multiplicity of perforations which may result in an increase of the total surface area of the resistively conductive coil sheet. The resistively conductive coil sheet may be planar and wrapped into a helix tubule. The helix tubule may, therefore, define an aperture which traverses through the middle of the helix tubule. The helix tubule further may be configured to receive a wicking material to wick a liquid medium to the resistively conductive coil sheet for evaporation.

This disclosure may also relate to a surface vaporizing element which may comprise a negative lead which may be configured for electrical communication with an anode portion of a galvanic cell and a positive lead which may be configured for electric communication with a cathode portion of the galvanic cell. A helix tubule coil sheet may connect to and span between the positive and negative lead. The tubule may further be resistive to electron flow which may generate heat upon passage of electrons from the positive lead to the negative lead. Further, the helix tubule coil sheet may have a multiplicity of perforations and an aperture. The aperture may traverse through the middle of the helix tubule and may be further configured to receive a wicking material.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of accompanying drawings. Accordingly, further advantages of the present invention may become apparent to those skilled in the art with the benefit of the following detailed description of the various embodiments and upon reference to the accompanying drawings in which:

FIG. 12 is a plan view of one non-limiting embodiment of a perforated coil;

FIG. 13 is a plan view of one non-limiting embodiment of a perforated coil;

FIG. 17 is a plan view of one non-limiting embodiment of a perforated coil wherein potential non-limiting configuration angles are illustrated;

FIG. 18 is a plan view of one non-limiting embodiment of a perforated coil wherein potential non-limiting configuration angles are illustrated;

FIG. 19 is a plan view of one non-limiting embodiment of a perforated coil wherein potential non-limiting configuration angles are illustrated;

FIG. 20 is a perspective view of one non-limiting embodiment of a vaporizer housing wherein the perforated coil may be installed into;

FIG. 21 is an additional perspective view of one non-limiting embodiment of a vaporizer housing wherein the perforated coil may be installed into;

FIG. 23 is a step by step formational illustrative perspective view of a helical tubule; and, FIG. 24 is a step by step formational illustrative perspective view of a helical screw.

DETAILED DESCRIPTION

Figure 1:
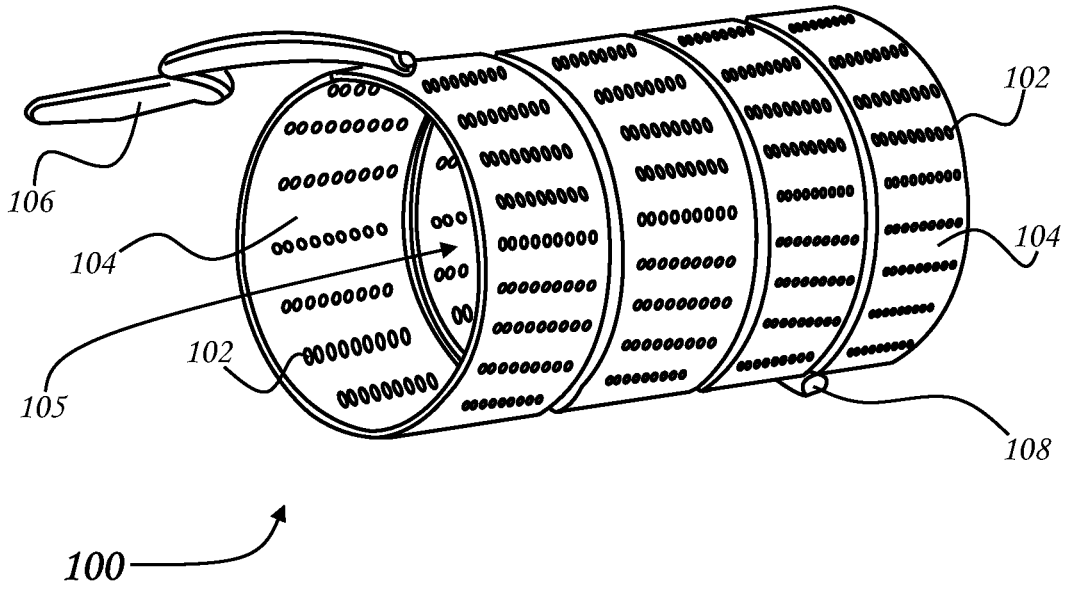
FIG. 1 is a perspective view of one non-limiting embodiment of a perforated coil.

Embodiments of systems, components, and methods of assembly and manufacture will now be described with reference to the accompanying figures. Although several embodiments, examples, and illustrations are disclosed below, it will be understood by those of ordinary skill in the art that the embodiments described herein extend beyond the specifically disclosed configurations, examples, and illustrations, and can include other uses of the disclosure and obvious modifications and equivalents thereof. The terminology used in the descriptions presented herein is not intended to be interpreted in any limited or restrictive manner simply because it is being used in conjunction with a detailed description of certain specific embodiments of the disclosure. In addition, embodiments of the disclosure can comprise several novel features and no single feature is solely responsible for its desirable attributes or is essential to practicing any one of the several embodiments herein described.

Certain terminology may be used in the following description for the purpose of reference only, and thus are not intended to be limiting. For example, terms such as "above," "below," "lower," or "upper" refer to directions in the drawings to which reference is made. Terms such as "front," "back," "left," "right," "rear," "top," "bottom," "side," and so forth describe the orientation and/or location of portions of the components or elements within a consistent but arbitrary frame of reference which is made clear by reference to the text and the associated drawings describing the components or elements under discussion.

Moreover, terms such as "first," "second," "third," and so on, may be used to describe separate components. Such terminology may include the words specially mentioned above, derivatives thereof, and words of similar import. Additionally, if directional references such as up, down, left, right, front, back, above, below, upper, lower, etc., were used in reference to the various figures, the directional indications of their relative positioning, and any dynamic movement is only limited to orientation of that particular drawing under consideration. If the original reference placement is changed, then the indication of directions should be changed accordingly. Furthermore, if terms such as first or second were used, they are solely used for the purpose of describing the logical manner for the implementation of the invention, it cannot be interpreted implicitly or explicitly as the relative importance or the number of unique features among the subjects discussed. When multiple unique features exist, it can be implicitly or explicitly indicated that there is at least one unique feature.

This disclosure may relate to the use and application of perforated coil 100. The perforated coil 100 may be specifically employed for the use of the vaporization of a wide variety of liquid mediums (not shown). Said liquid medium (not shown) may incorporate tobacco, medicinal substances and extracts, non-medicinal substances and extracts, and may further be elected to be nicotine-containing or non-nicotine containing. Moreover, the perforated coil 100 may be similarly referred to as a heating element through this discloser and the various appended claims, thus perforated coil 100 and heating element may be used interchangeably.

FIG. 1 shows one potential embodiment for a perforated coil 100. The perforated coil 100 as indicated in FIG. 1 is illustrated as having the perforated coil 100 in a wrapped helix tubule configuration as it may appear when installed and having an aperture 105. This helix tubule 400 (shown in FIG. 23) configuration is herein defined as a wrapping configuration wherein as the helix is formed, the sides of a coil sheet 104 align and abut to form the coil aperture 105. This is in contrast to that of a helix screw 402 (shown in FIG. 24) wherein a planer object is simply twisted from either end in opposite directions and form a screw-type structure. Rather, this helical tubule 400 forms the shown tube type formation and has the coil aperture 105 contained internal to the helical tubule. The formation of the helical tubule 400 may be better illustrated in FIG. 23.

Still referring to FIG. 1, a series of perforations 102 are shown. These perforations 102 may be of any size and/or shape suitable for the task of permitting a liquid medium to penetrate the perforated coil 100 and be held in place around the perforations 102. Moreover, perforation, as defined by this disclosure, shall refer to a portion of material that is completely removed from the perforated coil 100 thereby leaving a hole by which light, air, and liquid, may pass freely. As noted, the perforations 102 may measure any size, by way of example only, they may be as small as 50 micrometers or smaller as measured on one axis, to as large as 2 millimeters or larger as measured on one axis. The size of the perforations 102 may be dependent on the specific viscosity of the liquid medium (not shown). By way of example, a liquid medium (not shown) which has a viscosity closer to that of honey may require larger perforations 102 while a liquid medium (not shown) which has a viscosity closer to that of water may require smaller perforations 102. Because the perforated coil 100 may be heated rapidly to evaporate any held liquid medium (not shown), it may be useful to have a coil, such as this perforated coil 100, which may be custom-tailored to increase the overall surface area of the perforated coil 100 as may be required for a specific application. This may be achieved by using a wide variety of perforations 102 in the perforated coil 100 as may be illustrated later in this disclosure. In addition to increasing the overall surface area of a perforated coil 100, the perforations 102 of the perforated coil 100 may additionally permit the free flow of vapor 110 (shown in FIGS. 4 and 5) from the perforated coil 100.

Additionally shown in FIG. 1 is that of the coil sheet 104. Accordingly, the coil sheet 104 may hold the perforations 102 of the perforated coil 100. The coil sheet 104 may be of any type of material which may be suitable to rapid heating and cooling such that a liquid medium (not shown) may vaporize from the surface of the coil sheet 104. By way of non-limiting example only, the coil sheet 104 may comprise pure metals or various alloys of stainless steel, nickel, titanium, aluminum, chromium, copper, iron, zinc, tin, magnesium, and any of the various commonly known alloys including but not limited to Kanthal and Nichrome. Further illustrated are a positive lead 106 and a negative lead 108. The positive lead 106 and the negative lead 108 may control the flow of electricity (not shown) as it passes through the perforated coil 100. The perforated coil 100 may provide resistance to the flow of electricity (not shown) and rapidly heat up in response resulting in the liquid medium (not shown) being evaporated from the surface of the perforated coil 100.

Figure 2:
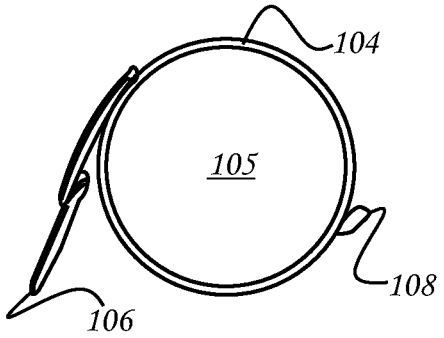
FIG. 2 is a side plan view of one non-limiting embodiment of a perforated coil wherein an aperture for the insertion of wicking material is shown.

FIG. 2 shows a downward view of FIG. 1 which may better illustrate the aperture 105 of the perforated coil 100. The aperture 105 may be used to hold the wicking material 112 as illustrated in FIGS. 4 and 5.

Figure 3:
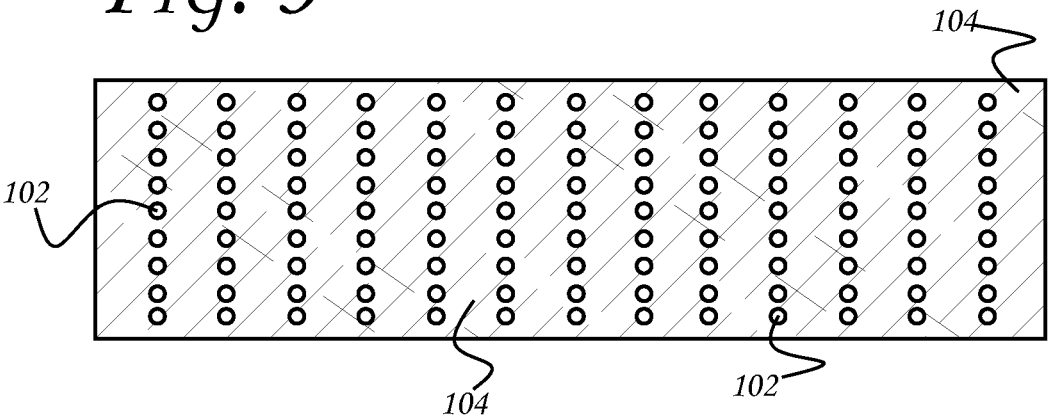
FIG. 3 is a plan view of one non-limiting embodiment of the perforated coil illustrated in FIG. 1.

FIG. 3 shows how the perforated coil 100 (as seen in FIG. 1) may appear prior to being coiled. The perforations 102 as illustrated in FIG. 3 are shown as being arranged in a linear order. It should be noted and will be further expressed by way of example in this disclosure, that such a linear order is not required, and may depend on the specific viscosity of the liquid medium (not shown). Moreover, the particular density illustrated in FIG. 3 is but one example of a wide number of potential densities of perforations 102 possible for use in the perforated coil 100.

Figure 4:
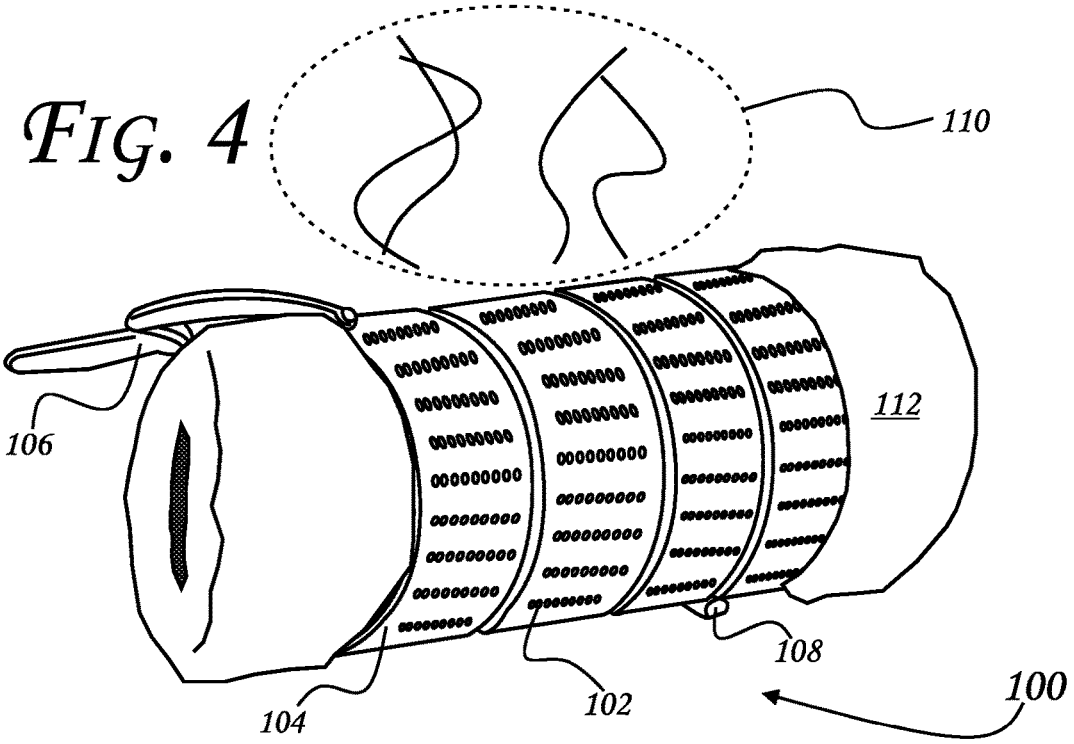
FIG. 4 is a perspective view of one non-limiting embodiment of a perforated coil wherein a wicking material has been inserted into the aperture of the perforated coil.
Figure 5:
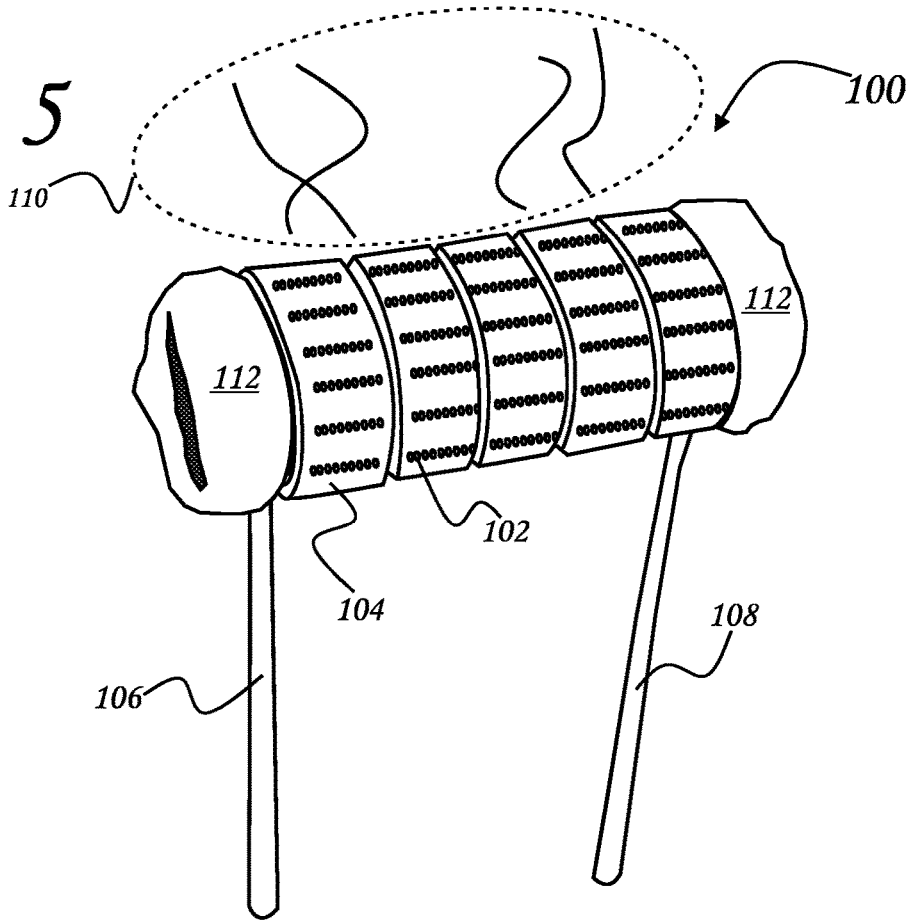
FIG. 5 is a perspective view of one non-limiting embodiment of a perforated coil wherein a wicking material has been inserted into the aperture of the perforated coil and electronic leads are illustrated as extending from the embodiment.

FIGS. 4 and 5 illustrate that the perforated coil 100 may be used in the creation and discharge of vapor 110. Such vapor 110 may be the result of a wicking material 112 being absorbent of, and in constant communication with, the liquid medium (not shown). The coil sheet may then be rapidly heated to produce the vapor 110 discharge illustrated. For illustrative purposes, the vapor 110 is shown internal to the dotted line circle as vapor 110 may not take a physical shape due to being in a gaseous state of matter. As can be viewed throughout these various figures, the coil sheet 104 may be fabricated as a flat perforated sheet and then rolled over itself to create an aperture 105 (as seen in FIG. 2). The wicking material 112 may then be inserted into the aperture 105. Generally, FIG. 4 may be illustrative of how the perforated coil 100 may appear once the wicking material 112 is included internal to the coiled shape. As noted, the wicking material 112 may be inserted into the aperture 105 of the perforated coil 100 either prior to coiling or subsequent to the coiling of the perforated coil 100. FIG. 5 specifically illustrates that the positive lead 106 and the negative lead 108 may be of a length necessary to make adequate contact with a power source (not shown) sufficient to rapidly heat the perforated coil 100.

Figure 6:
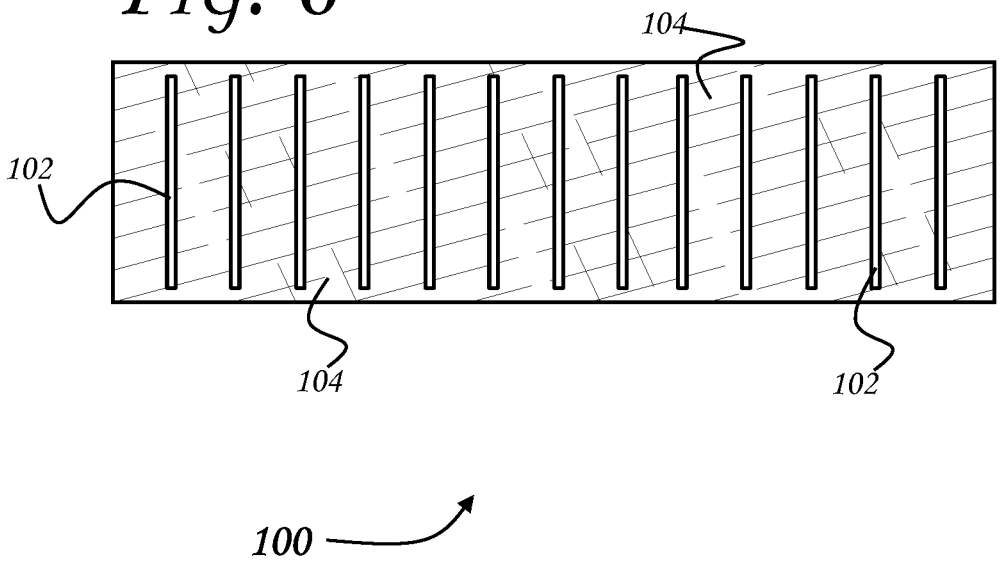
FIG. 6 is a plan view of one non-limiting embodiment of a perforated coil.
Figure 7:
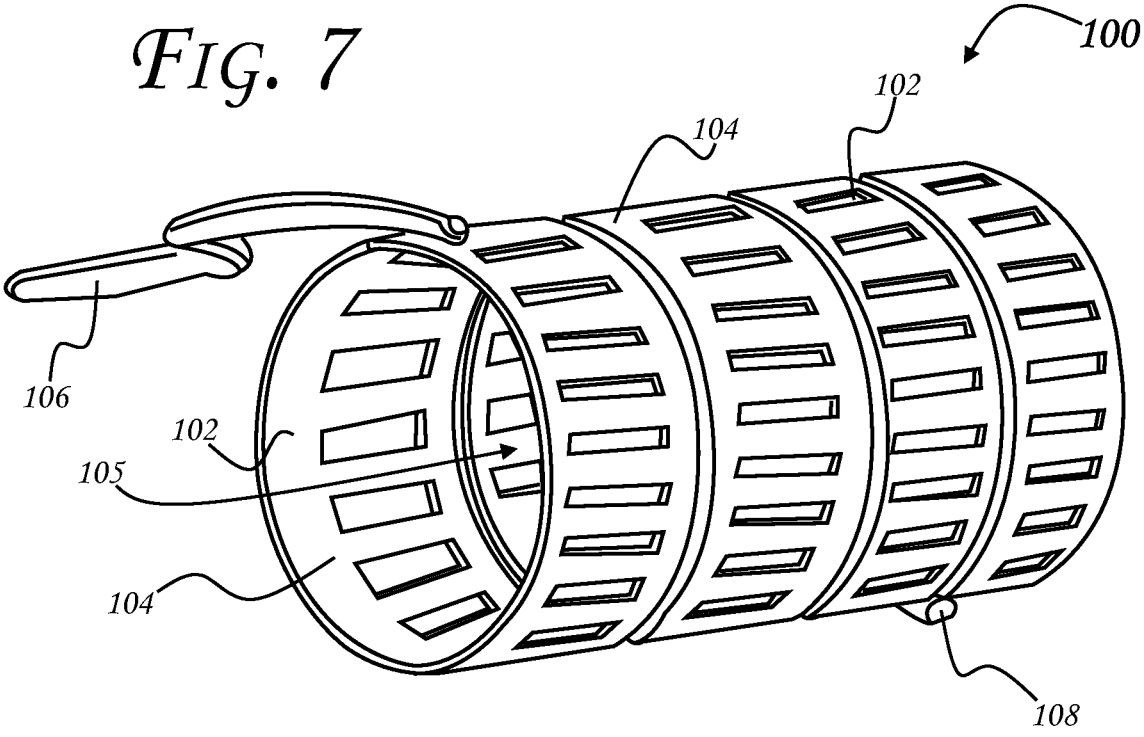
FIG. 7 is a perspective view of one non-limiting embodiment of a perforated coil as illustrated in FIG. 6.

FIG. 6 shows how a different potential embodiment of the perforated coil 100 (as seen in FIG. 7) may appear prior to being coiled. The perforations 102 as illustrated are shown as being arranged in a linear order and slotted perforations 102 instead of circular perforations 102. It should be noted and will be further expressed by way of example in this disclosure that such a linear order may not be required, and may depend on the specific viscosity of the liquid medium (not shown). Moreover, the particular density illustrated is but one example of a wide number of potential densities of perforations 102 possible for use in the perforated coil 100.

FIG. 7 shows another potential embodiment, as similar to FIG. 6, for the perforated coil 100. The perforated coil 100 as illustrated herein is in a wrapped configuration and appears as it may appear when installed. A series of slotted perforations 102 are shown in contrast to the circular type perforations 102 illustrated in FIG. 1. These slotted perforations 102 may be of any size and/or shape suitable for the task of permitting a liquid medium to penetrate the perforated coil 100 and be held in place around the perforations 102. As noted, the perforations 102 may measure any size, by way of example only, they may be as small as 50 micrometers or smaller as measured on one axis, to as large as 2 millimeters or larger as measured on one axis. The size of the perforations 102 may be dependent on the specific viscosity of the liquid medium (not shown). By way of example, a liquid medium (not shown) which has a viscosity closer to that of honey may require larger perforations 102 while a liquid medium (not shown) which has a viscosity closer to that of water may require smaller perforations 102. Because the perforated coil 100 may be heated rapidly to evaporate any held liquid medium (not shown), it may be useful to have a coil, such as this perforated coil 100, which may be custom-tailored to increase the overall surface area of the perforated coil 100 as may be required for a specific application. This may be achieved by using a wide variety of perforations 102 in the perforated coil 100 as may be illustrated in these FIGS. 5 and 6 and additionally later in this disclosure. In addition to increasing the overall surface area of a perforated coil 100, the perforations 102 of the perforated coil 100 may additionally permit the free flow of vapor 110 (shown in FIG. 4) from the perforated coil 100.

Additionally shown in FIGS. 6 and 7 are that of the coil sheet 104 with the alternative slot type perforations 102 illustrated. Accordingly, the coil sheet 104 may hold any type of embodied perforations 102 of the perforated coil 100. The coil sheet 104 may be of any type of material which may be suitable for the rapid heating and cooling such that a liquid medium (not shown) may vaporize from the surface of the coil sheet 104. By way of non-limiting example only, the coil sheet 104 may comprise pure elemental metals like stainless steel, nickel, titanium, aluminum, chromium, copper, iron, zinc, tin, magnesium, any or various alloys of the aforementioned, and any of the various commonly known and specially identified alloys including but not limited to Kanthal and Nichrome. Further illustrated are a positive lead 106 and a negative lead 108. The positive lead 106 and the negative lead 108 may control the flow of electricity (not shown) as it passes through the perforated coil 100. The perforated coil 100 may provide resistance to the flow of electricity (not shown) and rapidly heat up in response resulting in the liquid medium (not shown) being evaporated from the surface of the perforated coil 100.

Figure 8:
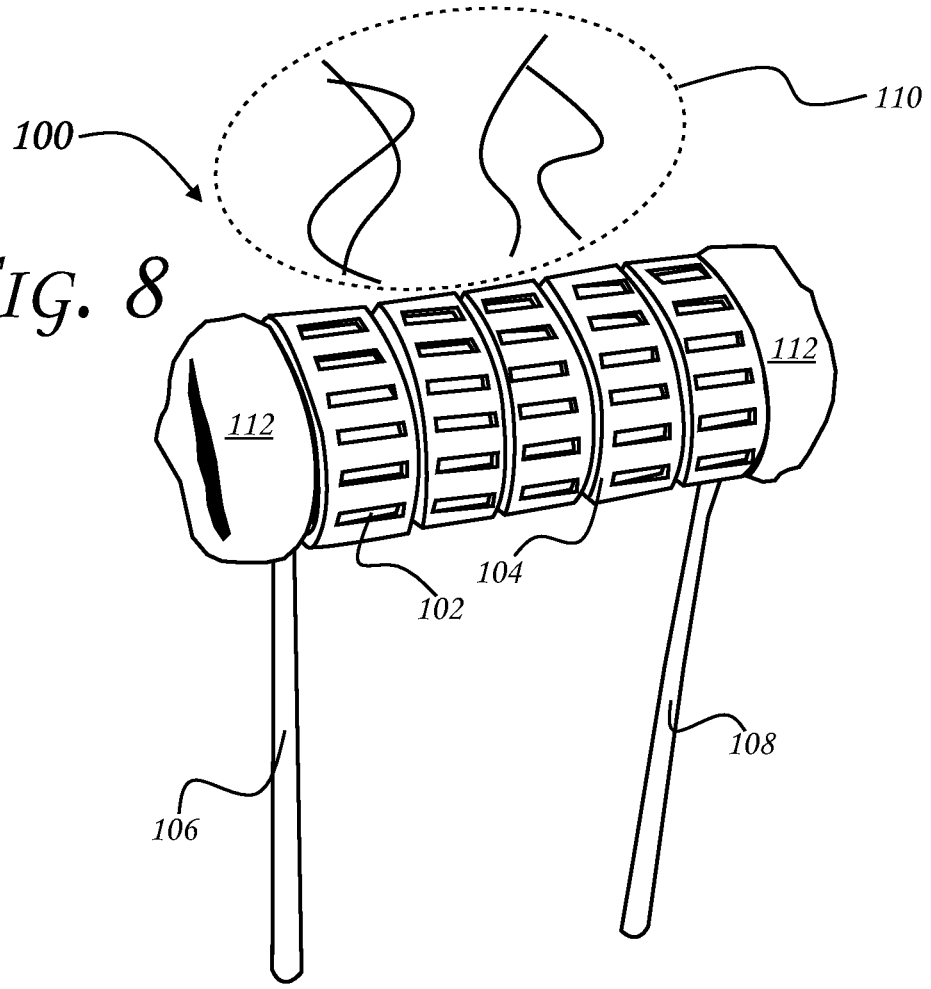
FIG. 8 is a perspective view of one non-limiting embodiment of a perforated coil wherein a wicking material has been inserted into the aperture of the perforated coil and electronic leads are illustrated as extending from the embodiment.
Figure 9:
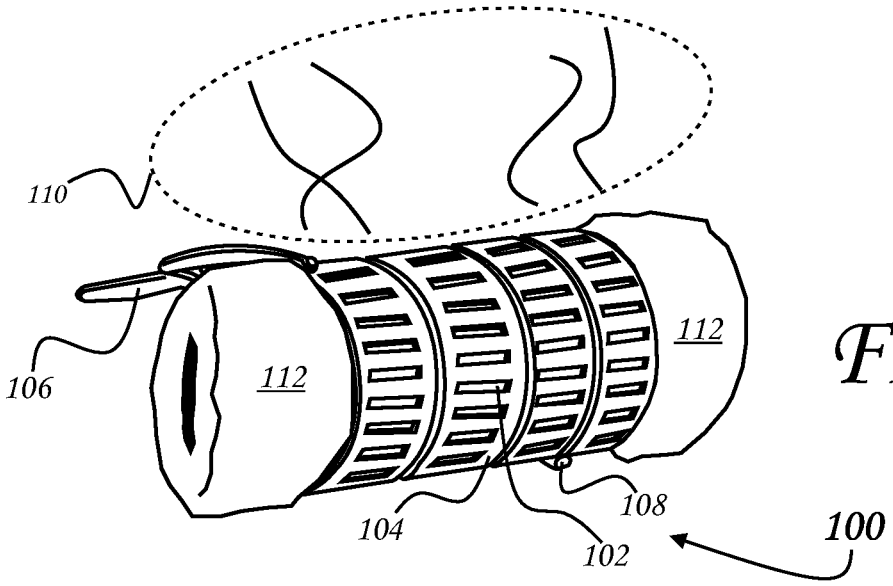
FIG. 9 is a perspective view of one non-limiting embodiment of a perforated coil wherein a wicking material has been inserted into the aperture of the perforated coil.

FIGS. 8 and 9 illustrate that the perforated coil 100 may be used in the creation and discharge of vapor 110, and in combination with FIGS. 4 and 5 should indicate that any potential embodiment of the perforated coil 100 may be capable of producing vapor 110. Such vapor 110 may be the result of a wicking material 112 being absorbent of the liquid medium (not shown) and then rapidly heated to produce the vapor 110 discharge illustrated. For illustrative purposes, the vapor 110 is shown internal to the dotted line circle as vapor 110 may not take a physical shape due to being in a gaseous state of matter. Moreover, FIG. 9 may be illustrative of how the perforated coil 100 may appear once the wicking material 112 is included internal to the aperture 105 (as seen in FIG. 2). The wicking material 112 may be inserted into the aperture 105 (seen in FIG. 1) of the perforated coil 100 either prior to coiling or subsequent to the coiling of the perforated coil 100. FIG. 8 specifically illustrates that the positive lead 106 and the negative lead 108 may be of a length necessary to make adequate contact with a power source (not shown) sufficient to rapidly heat the perforated coil 100.

Figure 10:
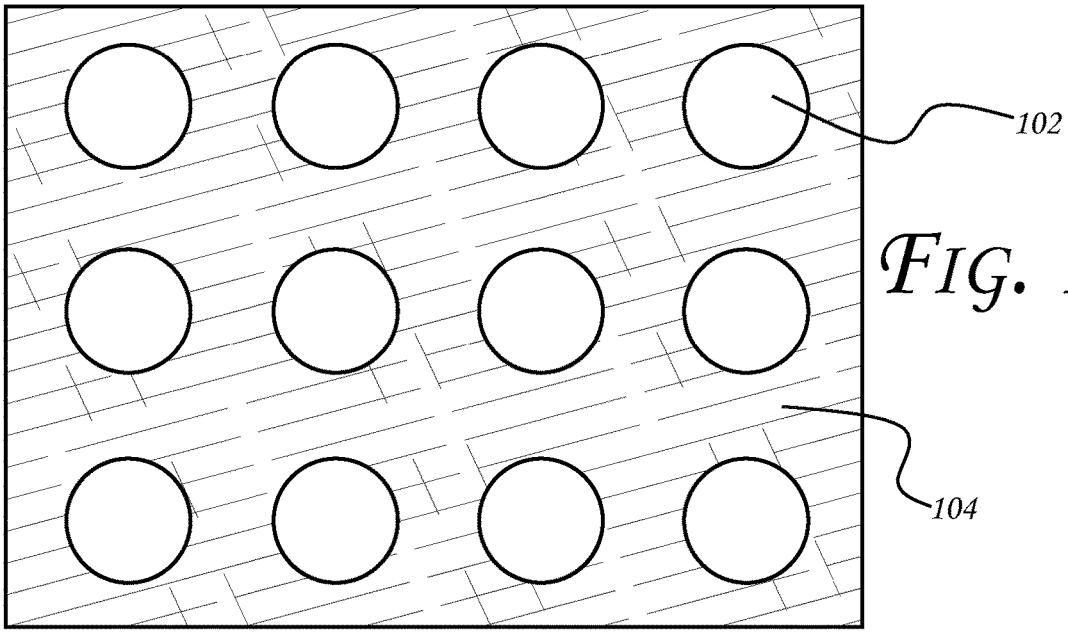
FIG. 10 is a plan view of one non-limiting embodiment of a perforated coil.
Figure 11:
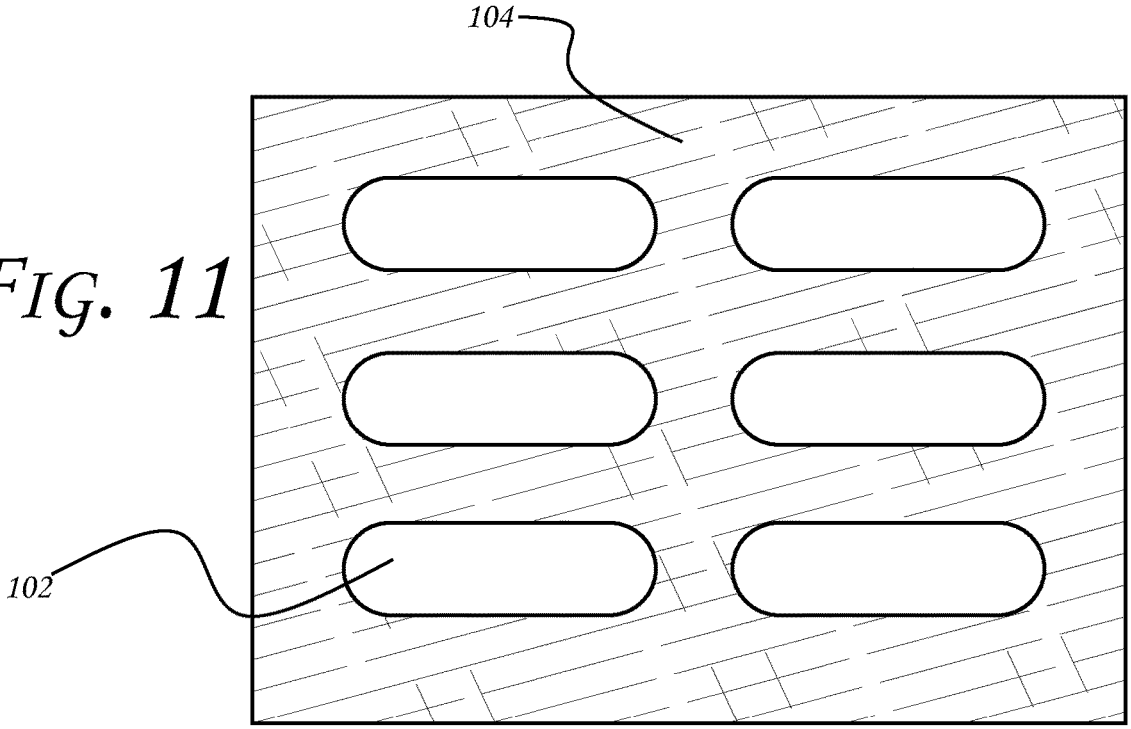
FIG. 11 is a plan view of one non-limiting embodiment of a perforated coil.
Figure 14:
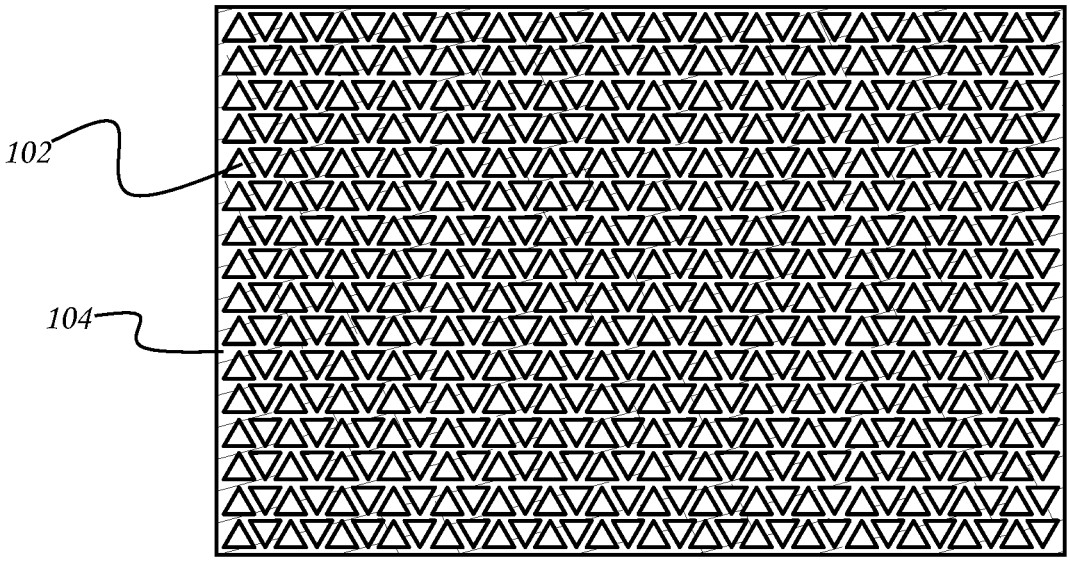
FIG. 14 is a plan view of one non-limiting embodiment of a perforated coil.
Figure 15:
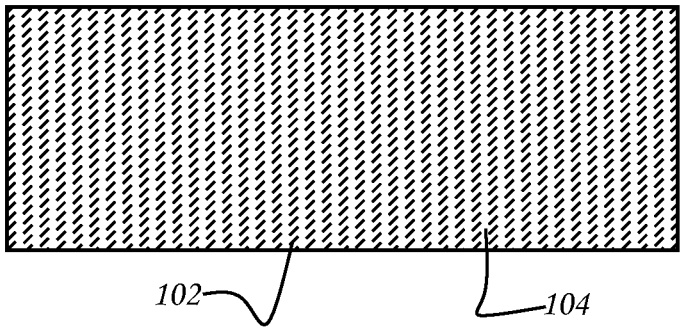
FIG. 15 is a plan view of one non-limiting embodiment of a perforated coil.
Figure 16:
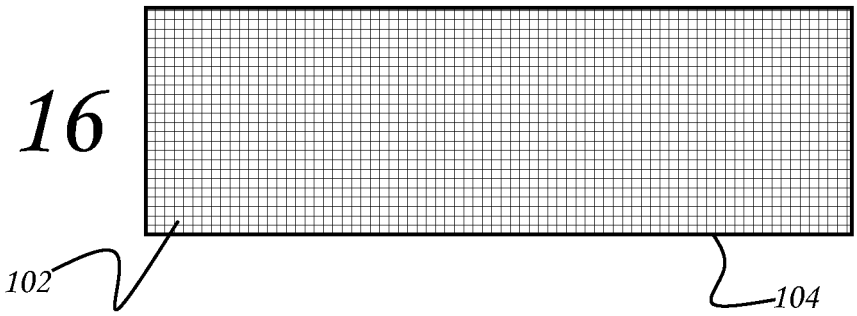
FIG. 16 is a plan view of one non-limiting embodiment of a perforated coil

FIGS. 10 through 16 show non-limiting illustrations of the concept that the perforations 102 may be placed as any configuration, pattern, shape, or size into the coil sheet 104 as may be contemplated. FIG. 10 is illustrative that the perforations 102 may be circular in shape. FIG. 11 is illustrative that the perforations 102 may be oblong, or elongated rectangular shapes. FIG. 12 is illustrative that the perforations 102 may be of more than one shape and pattern. Such patterning may be useful in the possible customizations for the various viscosities of liquid mediums (not shown). FIG. 13 is illustrative that the potential perforations 102 may not be of a regular shape, and may take any potential irregular contour available. FIG. 14 is illustrative that the potential perforations 102 may be triangular, and/or tightly packed onto the coil sheet 104. FIG. 15 is illustrative that the potential perforations 102 may be very small and may appear as only marks on the coil sheet 104. Such perforations 102 as illustrated in FIG. 15 may be laser cut. FIG. 16 is illustrative that the coil sheet 104 may be of a wired configuration wherein the perforations 102 may constitute the majority of the perforated coil 100. It should be explicitly stated that due to size limitations, not all potential configurations for the various embodiments of the perforations 102 may be disclosed herein. Many more such embodiments of the perforations 102 may be useful but not disclosed herein. The basic contour and outline of the perforations 102 shall in no way be limited by this disclosure.

FIGS. 17 through 19 show non-limiting illustrations indicating that the various perforations 102 may be applied to the coil sheet 104 by way of using angles 114 to determine the locations and layout of the perforations 102. By way of example only, illustrations in FIGS. 17 to 19 show these angles in the dotted line. FIG. 17 shows an angle 114 of 60 degrees. FIG. 18 shows an angle 114 of 45 degrees. FIG. 19 shows an angle 114 of 90 degrees.

FIGS. 20 and 21 show one potential vaporizer housing 300 for use with the perforated coil 100. Shown may be an upper cover 302, a suction port 304, a locking clip 306, and a lower cover 308. Other configurations for vaporizer housing 300 may be contemplated, the vaporizer housing 300 illustrated in FIGS. 20 and 21 are for further understanding of this disclosure and do not limit other potential embodiments.

Figure 22:
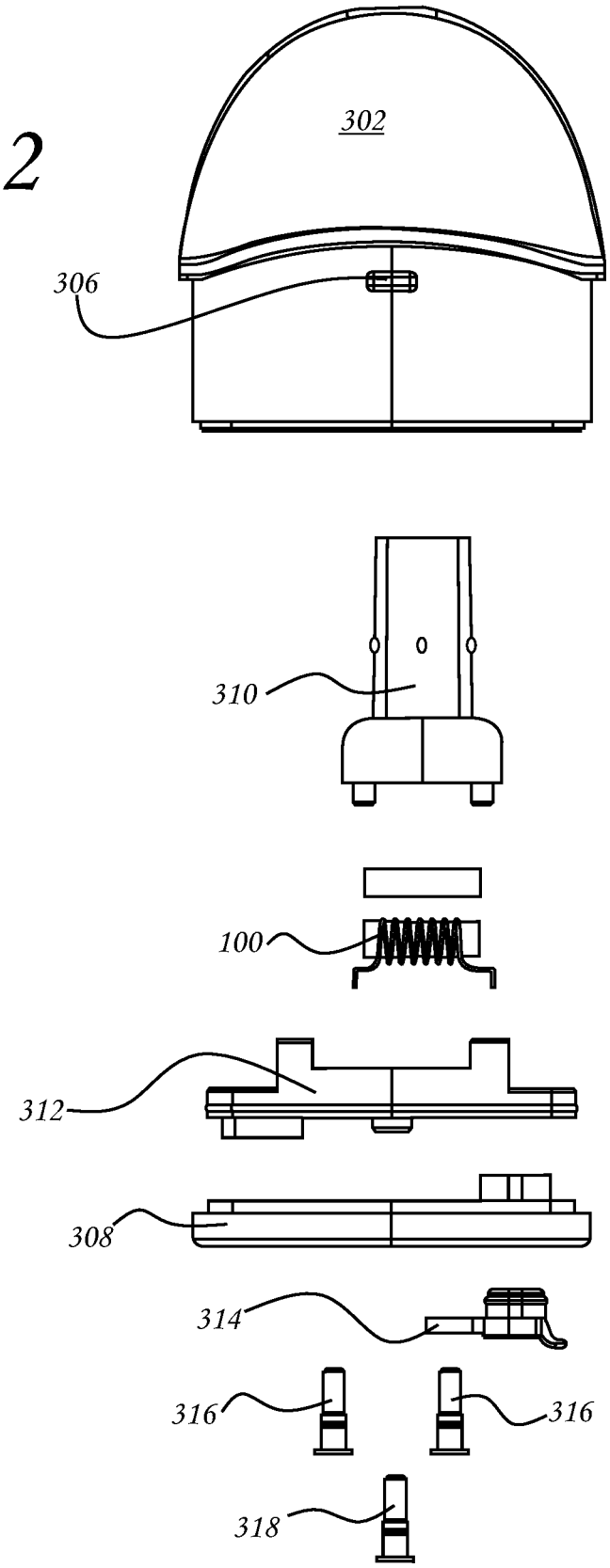
FIG. 22 is an exploded view of the non-limiting embodiments of FIGS. 20 and 21 wherein the relative positioning of the perforated coil may be better viewed.

FIG. 22 shows how the perforated coil 100 may be included in a working vaporizing assembly by illustrating an exploded view of the vaporizer housing 300 shown in FIGS. 20 and 21. For reference, FIG. 22 illustrates the upper cover 302, the suction port 304, the locking clip 306, the locking clip 306, an atomization chamber 310, a sealing layer 312, a refill assembly 314, an electrode 316, and a detector pin 318. Other configurations for vaporizer housing 300 may be contemplated, and other internal components of the vaporizer housing 300 as illustrated in FIG. 22 may also be contemplated. The vaporizer housing 300 illustrated in FIGS. 20 and 21, and internal components illustrated in FIG. 22, are for further understanding of this disclosure and do not limit other potential embodiments.

FIGS. 23 and 24 illustrate the differences between a helical tubule 400 and a helical screw 402, and how each may respectively be formed from the same planer sheet 404. The beginning point for each formation may be, as noted a planer sheet 404 of material. The planer sheet 404 may be similar to that of the coil sheet 104 illustrated in FIG. 3, and the process described in FIG. 23 may be the same process used to form the perforated coil 100. The process illustrated in FIG. 24 is for contrast only, and of note, is referred to only to differentiate and further elaborate as to what may be defined as a helical tubule 400. FIGS. 23 and 24 have been stripped of detail such that the essence of the shapes may be fully understood and described herein.

FIG. 23 specifically outlines the process from going from a planer sheet 404, or as mentioned, a coil sheet 104, to that of the final helical tubule 400, or by reference, the perforated coil 100. To achieve such a helical ribbon 406, a ribbon twist 412 may be applied to the planer sheet 404 such that an intermediary helical ribbon 406 may be developed. The ribbon twist 412 may be defined by an "over and around" type of motion as may be illustrated in FIG. 23. A continuation of the ribbon twist 412 as applied to the helical ribbon 406 may then result in the narrow sides 408 of the helical screw 402 to eventually come together and abut. This abutment forms the final helical tubule 400 and the coil aperture 105 (as illustrated in FIG. 2) may then be observed as traversing through the middle.

Contrastingly, FIG. 24 illustrates the formation of a helical screw 402. The formation of the helical screw 402 may be more direct, as may be illustrated by the screw twist 414 in FIG. 24. The screw twist 414 may be defined by a basic rotation in opposite directions from opposing ends of the planer sheet 404. Again, this figure and description have been included to contrast and further define the desired outcome of the helical tubule 400 illustrated in FIG. 23. The helical screw 402 may further be thought of as an auger in shape, or more generally, a screw; while the helical tubule 400 may be thought of generally as a tube.

Having disclosed the structure of the various embodiments, it is now possible to describe its function, operation, and use. Disclosed herein may be a heating element (also referred to as a perforated coil 100) for the evaporation of a liquid medium (not shown) which may comprise a coil sheet 104. The coil sheet 104 may be resistively conductive and span between a positive lead 106 and a negative lead 108. The positive lead 106 may be configured to electrically communicate with a positive terminal (not shown) of a battery (not shown). The negative lead 108 may be configured to electrically communicate with a negative terminal (not shown) of a battery (not shown). The coil sheet 104 may have a multiplicity of perforations 102 which may thereby increase the total surface area of the coil sheet 104. The coil sheet 104 may be planar and wrapped into a helical tubule 400 (as illustrated in FIGS. 1, 4, 7, 8, 9, and 23). The helix tubule 400 may further define the coil aperture 105 which traverses through the middle of the helix tubule 400. The helix tubule 400 may be configured to receive a wicking material 112 to wick a liquid medium to the resistively conductive coil sheet.

Further disclosed herein may be a heating element (also referred to as a perforated coil 100) for the rapid heating and subsequent evaporation of a liquid medium (not shown) which may have a negative lead 108 connected to a negative terminal (not shown) of a battery (not shown) and a positive lead 106 connected to a positive terminal (not shown) of the battery (not shown). Further, there may be a helix tubule 400 coil sheet 104 spanning between and connected to the positive lead 106 and the negative lead 108 which is resistively conductive. This resistive conductivity of the helix tubule 400 coil sheet 104 may cause rapid heating when an electric current (not shown) is delivered from the battery (not shown) to the helix tubule 400 coil sheet 104. The helix tubule 400 coil sheet 104 may further comprise a multiplicity of perforations 102 and an aperture 105 which traverses through the middle of the helix tubule 400 and has a wicking material 112 placed therein.

Further disclosed herein may be a heating element which may have a negative lead 108 which is connected to a negative terminal (not shown) of a battery (not shown) and a positive lead 106 which is connected to a positive terminal (not shown) of the battery (not shown). Moreover, a helix tubule 400 coil sheet 104 may span between the positive lead 106 and the negative lead 108 and may further be resistively conductive. Said resistive conductivity of the helix tubule 400 coil sheet 104 may cause rapid heating when an electric current (not shown) is delivered from the battery (not shown) to the helix tubule 400 coil sheet 104. The helix tubule 400 coil sheet 104 may further have a multiplicity of perforations 102 and an aperture 105 which traverses through the middle of the helix tubule 400. A wicking material 112 may be placed internal to the aperture 105 of the helix tubule 400.

Further disclosed herein may be a surface vaporizing element having a negative lead 108 which may be configured for electrical communication with an anode portion (not shown) of a galvanic cell (not shown). Further, a positive lead 106 may be configured for electrical communication with a cathode portion (not shown) of the galvanic cell (not shown). A helix tubule 400 coil sheet 104 may span between and connect to the positive lead 106 and the negative lead 108 which may be further resistive to electron flow. Such resistance may thereby generate heat upon passage of electrons (not shown) from the positive lead 106 to the negative lead 108. The helix tubule 400 coil sheet 104 may have a multiplicity of perforations and an aperture 105 which may traverse through the middle of the helix tubule 400. The coil aperture 105 may be further configured to receive a wicking material 112.

The wicking material 112 may be cotton, silica, rayon fibers, or stainless steel mesh. The perforations may be circular, round, polygonal, circular and polygonal on the same coil sheet 104, be regularly space, or be irregularly spaced.

While embodiments of the disclosure have been illustrated and described, it is not intended that these embodiments illustrate and describe all possible forms of the invention. Rather, the words used in the specification are words of description rather than limitation, and it is understood that various changes may be made without departing from the spirit and scope of the invention.

Accordingly, it is not intended that the disclosure be limited except by the appended claims. Insofar as the description above and the accompanying drawings disclose any additional subject matter that is not within the scope of the claims below, the various embodiments are not dedicated to the public and the right to file one or more applications to claim such additional inventions is reserved.

Furthermore, this disclosure relates to the implementation of an electronic cigarette (not shown) perforated coil 100 for heating of a liquid medium (not shown) resulting in the vaporization of said liquid medium (not shown). The perforated coil 100 may use perforations 102 placed into a coil sheet 104, which is wrapped into a helical tubule 400 to achieve this result. Accordingly, the implemented prototype described above is drawn as a reference for the actual structural design of an electronic cigarette (not shown) heating element. Since the electronic cigarette (not shown) is derived from all of the technical practices as described above, rights are reserved for all the benefits gained from any and all of the points stated above, for the development of a perforated coil 100 for use in electronic cigarettes (not shown).

The contents above described the prioritized implementation example for this invention, it is not used to set the limitation for the rightful claim of this invention. Any ideas that build on the scope of this invention, the use of this invention claims, drawings, in which leads to any structural design with the same functionalities, or directly and indirectly applied in other related technical fields, are all considered to fall under the rightful claim and protection of this invention.

What is claimed is:

1. A heating element for the evaporation of a liquid medium comprising;

a resistively conductive coil sheet spanning between and connected to a positive lead and a negative lead, the positive lead configured to electrically communicate with a positive terminal of a battery, the negative lead configured to electrically communicate with a negative terminal of a battery;

the resistively conductive coil sheet having a multiplicity of perforations thereby increasing the total surface area of the resistively conductive coil sheet;

the resistively conductive coil sheet being planar and wrapped into a helix tubule, the helix tubule defining an aperture which traverses through a middle of the helix tubule; and, the aperture of the helix tubule being configured to receive a wicking material to wick a liquid medium to the resistively conductive coil sheet.

2. The heating element for the evaporation of a liquid medium of claim 1, wherein the wicking material is cotton.

3. The heating element for the evaporation of a liquid medium of claim 1, wherein the wicking material comprise stainless steel mesh.

4. The heating element for the evaporation of a liquid medium of claim 1, wherein the perforations are round.

5. The heating element for the evaporation of a liquid medium of claim 1, wherein the perforations are polygonal.

6. A heating element comprising:

a negative lead connected to a negative terminal of a battery;

a positive lead connected to a positive terminal of the battery;

a helix tubule coil sheet spanning between the positive lead and the negative lead and being resistively conductive;

the resistive conductivity of the helix tubule coil sheet causing rapid heating when an electric current is delivered from the battery to the helix tubule coil sheet;

the helix tubule coil sheet having a multiplicity of perforations;

the helix tubule coil sheet having an aperture which traverses through a middle of the helix tubule; and, a wicking material being placed internal to the aperture of the helix tubule.

7. The heating element of claim 6, wherein the wicking material is cotton.

8. The heating element of claim 6, wherein the wicking material comprise stainless steel mesh.

9. The heating element of claim 6, wherein the perforations are round.

10. The heating element of claim 6, wherein the perforations are polygonal.

11. A surface vaporizing element comprising:

a negative lead configured for electrical communication with an anode portion of a galvanic cell;

a positive lead configured for electrical communication with a cathode portion of the galvanic cell;

a helix tubule coil sheet spanning between and connected to the positive lead and the negative lead and being resistive to electron flow thereby generating heat upon passage of electrons from the positive lead to the negative lead;

the helix tubule coil sheet having a multiplicity of perforations;

the helix tubule coil sheet having an aperture which traverses through a middle of the helix tubule and is configured to receive a wicking material.

12. The surface vaporizing element of claim 11, wherein the wicking material is cotton.

13. The surface vaporizing element of claim 11, wherein the wicking material comprises stainless steel mesh.

14. The surface vaporizing element of claim 11, wherein the perforations are round.

15. The surface vaporizing element of claim 11, wherein the perforations are polygonal.

* * * * *